United States Patent [19]

Dinnissen

[11] Patent Number: 4,546,963

[45] Date of Patent: Oct. 15, 1985

[54] SHEET SEPARATION APPARATUS

[75] Inventor: Johannes H. A. Dinnissen, Venlo, Netherlands

[73] Assignee: Océ-Nederland B.V., Venlo, Netherlands

[21] Appl. No.: 368,229

[22] Filed: Apr. 14, 1982

[30] Foreign Application Priority Data

Apr. 21, 1981 [NL] Netherlands ..... 8101927

[51] Int. Cl.[4] ..... B65H 3/46; B65H 1/06

[52] U.S. Cl. ..... 271/35; 271/122; 271/125

[58] Field of Search ..... 271/122, 125, 34, 35, 271/121, 10, 135, 165, 167; 221/277

[56] References Cited

U.S. PATENT DOCUMENTS

| | | | |
|---|---|---|---|
| 2,892,629 | 6/1959 | Osgood et al. | 271/122 |
| 3,372,925 | 3/1968 | de Vries et al. | 271/37 |
| 3,635,465 | 1/1972 | Beery | 271/122 |
| 3,773,317 | 11/1973 | Kummerer | 271/122 |
| 3,831,928 | 8/1974 | Davis | 271/35 |
| 3,857,559 | 12/1974 | McInerny | 271/122 |
| 4,050,690 | 9/1977 | Michelson | 271/125 |

FOREIGN PATENT DOCUMENTS

| | | | |
|---|---|---|---|
| 2719182 | 11/1978 | Fed. Rep. of Germany . | |
| 2825086 | 1/1979 | Fed. Rep. of Germany | 271/122 |

OTHER PUBLICATIONS

IBM Technical Disclosure Bulletin, vol. 19, No. 7, Dec. 1976, pp. 2694–2695.

*Primary Examiner*—Bruce H. Stoner, Jr.
*Assistant Examiner*—James E. Barlow
*Attorney, Agent, or Firm*—Albert C. Johnston

[57] ABSTRACT

Sheets being advanced on a driven conveyor with one sheet at least partially overlapped by another are separated in the transport path, so that only one sheet is fed at a time, by the action of a friction member such as a roller which is mounted for swinging movement relative to a line of contact with the sheets for pressing the sheets against the conveyor and is biased by a spring and/or its own weight in the direction opposite to the transport direction. The axis of swinging movement is parallel to the line of contact and so located that a plane through the swing axis and the plane of the transport path at that line, as viewed in the transport direction, forms an angle of between about 70° and 90°. The friction member preferably is a roller which is rotated at a relatively low speed so as to move its peripheral surface in the direction opposite to the transport direction. Sheet separations can be effected reliably over long periods of service of the apparatus, with little dependence of the effective frictional forces on the coefficient of friction between the friction member and the sheets.

9 Claims, 2 Drawing Figures

SHEET SEPARATION APPARATUS

Figure 1:
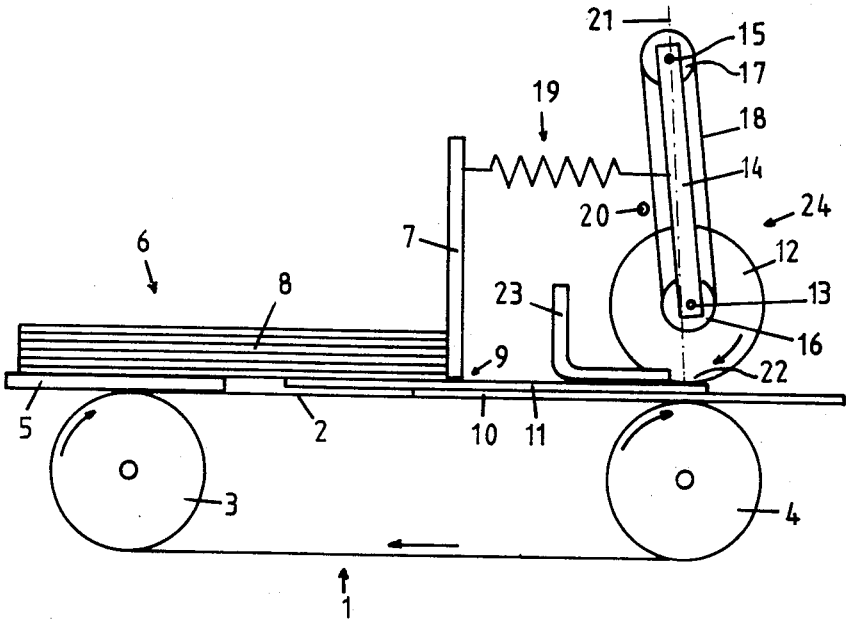

The present invention relates to sheet separation, and particularly to an apparatus for separating stacked or overlapping sheets to enable feeding them individually to a device such as a photocopying machine.

German patent application No. 2,719,182 discloses a device for separating sheets. Disclosed are a drivable conveyor, a friction means which slows the conveyance, and a path for transporting the sheets between the conveyor means and the friction means. When sheets are present, the friction means presses the sheets against the conveyor to insure separation. The friction means is rotatable about an axis, the axis being eccentric to the axis of the friction means and lying parallel with the line of contact between the friction means and the fed sheets.

According to one embodiment of the German patent application, the conveyor comprises a belt that runs in circular fashion over two rollers and exerts a pressure on the top sheet in the stack. One of the rollers is positioned directly over the stack and moves a first portion of the belt carried on the second roller. The friction means comprises a resilient strip that is supported at a fixed point such that a force is exerted on the sheets in a direction normal to that of transport. By virtue of this arrangement, the force applied to the sheets is independent of the coefficient of friction between the sheets to be separated.

According to another embodiment disclosed in the German patent application, a friction means is pressed against the fed sheets by a rotatable arm to which torque is applied by means of a spring. The angle between the plane of transport and the plane through the shaft and the line along which the sheets come into contact with the friction means is roughly 165°, when viewed in the direction of transport. This angle was selected for the purpose of increasing the force applied by the friction means when the coefficient of friction between the surfaces of the fed sheets increases. However, this arrangement suffers from the disadvantage that sometimes an excessive frictional force is exerted upon the sheets. Because the excessive frictional contact can damage or even wear away text and other image portions of documents, this separation apparatus is unsuitable for a number of uses such as separating originals that are automatically, sequentially fed to an exposure position of a copying machine.

According to the same German patent application, if the angle is approximately 45° when viewed in the direction of transport, the pressing force exerted by the friction means decreases as the coefficient of friction between the sheets increases. As a result, the frictional force between the sheets which are pressed upon each other is fairly independent of the coefficient of friction between the sheets. However, while an angle of 45° is more favorable than an angle of 165° for handling originals in a copying machine, all of the known embodiments still suffer from the disadvantage that the frictional force between the fed sheets and the friction means decreases upon repetitive use. This is caused by the friction means becoming smoother due to a variety of causes, including contamination, and reduces the ability to separate fed sheets. Simply, because the friction means loses its ability to exert a restraining force upon repetitive use, it can no longer arrest the movement of a sheet that is in frictional contact with the sheet that it is desired to feed.

The principal object, according to the present invention is to provide a sheet separation apparatus which will continue to separate fed sheets over a long period of time by using a slight pressing force and is, therefore, excellently suited for application to a copying machine feed mechanism which must automatically feed separated sheets for copying.

This object is achieved in accordance with the present invention which provides an apparatus for separating sheets conveyed in at least partially overlapping relation. The apparatus comprises: a drivable conveyor means for conveying sheets along a transport path; and friction means for pressing said sheets against said conveyor means along a line of contact transverse to said transport path, said friction means being swingable about an axis lying parallel to said line of contact and so located that a plane extending through said axis and said line of contact intersects said transport path at said line of contact at an angle of between about 70° and 90° thereto.

Figure 2:
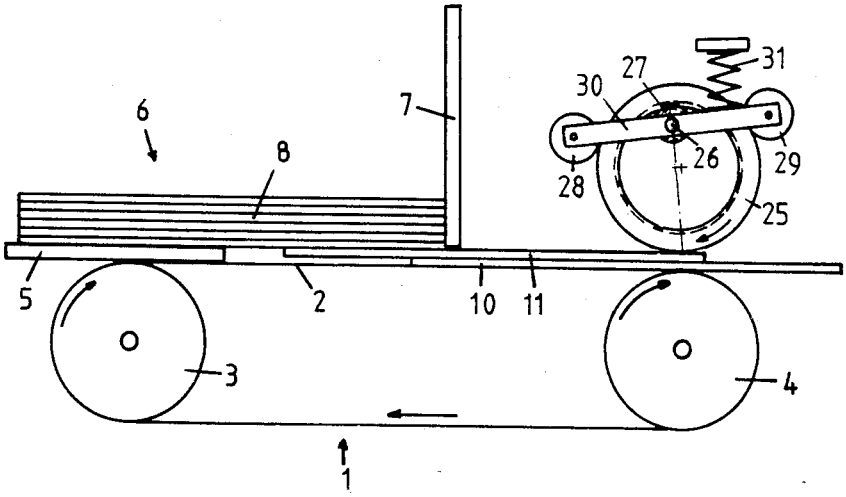

The present invention will be better understood and its advantages will become more apparent from the following detailed description, especially when taken in light of the accompanying drawings wherein:

FIG. 1 is a schematic representation of a sheet transporting apparatus provided with a sheet separation apparatus according to the invention; and FIG. 2 is a schematic representation of a sheet transporting apparatus employing a sheet separation apparatus according to another embodiment of the invention.

The sheet transporting apparatus shown in FIG. 1 comprises a conveyor means, shown generally as 1, having an endless belt 2 which is provided with a surface, such as rubber, that has a high coefficient of friction. The endless belt travels in the direction of the arrows while being supported by a plurality of rollers, here shown as rollers 3 and 4, that are arranged in a horizontal plane about parallel shafts. The belt 2 is driven at a suitable peripheral speed, typically about 15 meters per minute, with the aid of a motor, not shown, that drives one of the rollers, such as roller 4. A portion of the belt near roller 3 and a flat plate 5 positioned above roller 3 together form the bottom of a rectangular holder 6. The holder 6 further contains three connected vertical walls, one of which, wall 7, extends transversely across the belt 2. The other two walls, that extend on both sides along the belt, are not shown. The top of the holder and the side opposite to wall 7 are left open so as to enable the insertion of a stack of sheets 8. The sheets within the stack 8 can be stacked vertically one upon the other or in any other suitable overlapping arrangement. An aperture 9 is provided between wall 7 and the belt 2 to permit discharge of the sheets from the stack 8 onto the belt 2. The sheets are conveyed from the portion of the belt that forms part of the holder 6 towards a second belt portion supported by roller 4, which is located outside of the holder 6.

FIG. 1 shows two sheets, 10 and 11, partially discharged from the stack of sheets 8. The leading edge of sheet 11 is shown as it arrives under a friction creating assembly 24 which is attached above the portion of the moving endless belt 2 which projects beyond the holder 6. The friction creating assembly 24 comprises a friction means 12, which is shown here as a roller having a surface layer of a high friction material such as rubber. The roller 12 is rotatably mounted on a shaft 13 that is supported at one end of arm 14. The other end of arm 14 is rotatable about an axis, here shown as shaft 15. The axis at shaft 15 is eccentrically located with respect to the central axis of roller 12. A motor, not shown, is connected to shaft 15, causing rotation of roller 12 about shaft 13 by means of pulleys 16 and 17 that are rotationally interconnected by means of a flexible cable or rope 18.

The rollers 3 and 4, which drive the belt 2, and the roller 12, which functions as the friction means, are rotated in the same direction so that their peripheral speeds along the line of contact are in opposition. The term "line of contact" means the line which can be drawn between the conveyor means 2 and the friction means 12 at the place where the resultant of the normal forces, applied from the friction means 12 to the sheets, is exerted. Generally, this force is applied along a line which is perpendicular to the direction of transport of the sheets along the transport path. The transport path is defined by the direction of sheet movement by the conveyor means at the line of contact. Where a cylindrical or other curved surface is employed on the conveyor means, the transport path will be defined by a plane tangent to the conveyor means at the line of contact. While some degree of compression of the surface of the friction means 12 may occur, the line of contact is considered to be the center of the contact surface between the friction means 12 and the sheets fed in contact therewith.

It is a principal feature of the present invention that sheets can be reliably separated over extended periods of operation when the friction means 12 is positioned relative to shaft 15 and the line of contact, shown generally in this side elevation view to be at point 22, such that a plane extending through the axis of shaft 15 and the line of contact intersects the transport path at the line of contact at an angle of between about 70° and 90° thereto. Moreover, long-term, reliable operation is achieved without adversely affecting the sheets which are typically original documents being copied by a photocopier apparatus.

A spring 19 is tensioned between the vertical wall 7 and the arm 14 at a location which is preferably situated roughly one-half of the way between shafts 13 and 15. As a result of the tension, the friction means 12 is pressed against the top sides of sheets fed along the transport path. This tension tends to bias the arm toward larger angles within the defined range of 70° to 90°. A cam 20 is fastened to a frame plate, not shown, on the same side of the arm 14 that the spring 19 is positioned. The cam 20 prevents the arm 14 from being pulled too far toward the stack of sheets 8 when the supply is exhausted or sheets otherwise fail to feed. A curved plate 23 is provided between the vertical wall 7 and the friction creating assembly 24, to limit upward movement of sheets within the transport path. This prevents the top sheet from being pressed upwardly by the friction means 12 as sheets are fed along the transport path.

In the illustrative apparatus shown in FIG. 1, the angle between the plane of the transport path formed by the top side of the belt 2 and the connecting line 21 between the shaft 15 and the line of contact indicated by point 22, is roughly 86°, and is to some extent dependent upon the thickness of the sheets positioned between the friction means 12 and the belt 2. With angles between 70° and 90°, the frictional force between the friction means 12 and the sheets is, within wide limits, fairly independent of the coefficient of friction between the friction means 12 and the sheets. Upon a decrease of the coefficient of friction between the friction means 12 and the sheets, the apparatus of the present invention advantageously responds by causing a corresponding increase in the associated normal force. Thus, the apparatus of the present invention automatically adjusts to sheets of varying coefficients of friction to enable application of a normal force effective to provide separation between two sheets in direct response to the frictional characteristics of the sheets.

While the most favorable angle defined would be close to 90°, an angle of 90° can be used only where the surface of the friction means 12 or the conveyor 2 is deformed upon pressing one against the other; however, this system becomes less stable than would be desired. And, when employing relatively nondeformable friction and conveyor means, an angle of precisely 90° is impractical because the friction means 12 will no longer be pressed against the sheets, but will hang freely on the arm 14. For this reason, the angle should preferably not exceed 89°. Decreasing the angle from 90° to the lower limit of about 70° results in a gradual decrease in the desired effect. At 70° the result is still much improved over smaller angles, but to achieve the optimum results, the angle should preferably not be less than 80°.

The reliable service life of the apparatus according to the present invention is extended even further where the friction means comprises a roller, such as that indicated at 12 in the drawings, which can rotate around its own axis indicated by shaft 13 in the drawing, and which is driven at a peripheral speed that is not more than one-fifth of the transport speed of the conveyor and at the line of contact is opposite to the direction of the conveyor. The roller 12 can be driven at an extremely low peripheral speed of, for example, 25 centimeters per minute, with hardly any effect on the frictional force between it and the sheets. The extension of the service life is probably brought about by a self-cleaning action of the roller 12 by its rotation. This would tend to extend the period before the roller becomes contaminated.

The sheet separation apparatus according to the invention can be operated at a wide range of transport speeds while still providing the advantage of long periods of operation without breakdown. The peripheral speed of the conveyor belt 2 in the embodiments shown in the Figures can be adjusted without difficulty to any speed within the range of from about 5 to about 35 meters per minute. Similarly, the friction means 12 can be driven at varying speeds, but in the embodiment described a speed of less than about 2 meters per minute is preferred. At speeds significantly above this, sheets cannot be forced backwards due to the weight of the stack and the small distance between the friction means 12 and the stack of sheets 8. Typically, the peripheral speed of the friction means 12 will be about one meter per minute. According to other embodiments of the invention, in which the distance between the friction means 12 and the stack of sheets 8 exceeds the size of the sheets in the direction of feed, the friction means 12 can be driven at a speed of greater than 2 meters per minute.

There is no lower limit to the peripheral speed of the friction means 12. Thus, the speed can be as low as 25 centimeters per minute, or even 0. In the latter case, the friction means 12 need not comprise a roller as shown in the figure, but could be a contact shoe or a suitably formed end portion of the arm 14 so that, assuming a suitable choice of material, the end of the arm itself forms the friction means. It will be understood also that embodiments are feasible where no spring 19 is employed for generating the pressing force, but that the dead weight of the friction means itself or the weight of an extension of the arm can cause the necessary degree of pressure against the sheets. Moreover, the belt 2 can be designed to enable it to be swiveled out of the way to avoid undesirable forces on the sheets and hence wear of the sheets when at certain times it is desired to interrupt feeding of the sheets.

The sheet transporting apparatus according to FIG. 2 differs from that according to FIG. 1 only in the construction and mounting of the friction means. Parts shown in FIG. 2 which correspond to parts of the sheet transporting apparatus according to FIG. 1, are marked with the same reference numerals as in FIG. 1 and are not again discussed here.

In the sheet transporting apparatus according to FIG. 2, a friction means 25 is fitted at the same place as the friction means 12 in the transporting apparatus according to FIG. 1. The friction means 25 comprises a cylinder which is provided with teeth at its inside. The cylinder is supported by rotary drive means, shown as a toothed wheel 27, which is rotatably mounted on a shaft 26 inside the cylinder. The friction means 25 is also swingable, to swing bodily about an axis formed by the line of tangency between the toothed wheel 27 and the inside of the friction means 25. It can be seen that this axis of swinging movement is eccentrically positioned in relation to the central axis of cylinder 25. The plane between said swing axis and the contact line between the friction means and the plane of the transport path forms an angle of about 83° with the transport plane when the sheet transporting apparatus is in operation.

The cylinder 25 is pressed onto the toothed wheel 27 by means of two rollers 28 and 29 that are contacted with the cylinder at its topside. The rollers 28 and 29 are mounted at opposite ends of an arm 30. The arm 30, in turn, is rotatably mounted on the shaft 26 of the toothed wheel 27, and the shaft is mounted between the two ends of the arm. The roller 29 is pressed on the cylinder by means of a spring 31 that presses on the arm 30 between the shaft 26 and the roller 29. The roller 29 presses against the upper surface of the cylinder at the exit side of the transporting apparatus. The cylindrical friction means 25 is rotatable in the direction of the arrow and is driven by the toothed wheel 27.

I claim:

1. An apparatus for separating sheets being advanced along a transport path in at least partially overlapping relation on a conveyor to a relatively non-displaceable sheet supporting portion of the conveyor, comprising: a bodily displaceable friction member biased toward a position for pressing said sheets against said supporting portion of said conveyor by bearing on said sheets along a line of contact located opposite said supporting portion and extending transverse to said transport path and means mounting said friction member for free swinging movement into, and by friction of said sheets from, the location of said line of contact about an axis lying parallel to said line of contact, said axis being so located that a plane extending through said axis and said line of contact intersects said transport path at an angle thereto, viewed in the direction of sheet transport, in the range of between 70° and 90°.

2. An apparatus according to claim 1, said angle being within the range of from about 80° to 89°.

3. An apparatus according to claim 1 or 2, said friction member being a roller and said apparatus further comprising means for rotating said roller about its own axis in the direction at said line of contact opposite to the direction of sheet transport, at a peripheral speed not greater than one-fifth of the transport speed of said conveyor.

4. An apparatus according to claim 3, said conveyor being operable to advance said sheets at a speed within the range of from about 5 to about 35 meters per minute and said roller rotating means being operable to drive said roller at a peripheral speed of less than about 2 meters per minute.

5. An apparatus according to claim 1 or 2 and further comprising spring means continually biasing said friction member toward a greater angle within said range, relative to said transport path, in the direction opposite to the direction of sheet transport.

6. An apparatus according to claim 1 or 2, said friction member being a hollow cylindrical roller hung by its inner surface swingably about an axis on, and rotatable by rotation of, a rotatable element drivably engaging its inner surface, said rotatable element being drivable to rotate said hollow roller so that its outer surface at said line of contact is moved in the direction opposite to the direction of sheet transport.

7. An apparatus according to claim 6, further comprising positioning rollers bearing upon upper portions of the outer surface of said hollow roller at opposite sides of said rotatable element, said positioning rollers being supported on opposite end portions of an arm pivotable about the axis of said rotatable element, and spring means acting on said arm to bias it and said positioning rollers in a direction such that said hollow roller is biased yieldably about said rotatable element in the direction opposite to the direction of sheet transport.

8. An apparatus according to claim 1 or 2, said friction member being mounted on the lower end of at least one swingable arm the upper end of which is fixed pivotably on said axis, and spring means acting on said arm to bias it and said friction member yieldably about said axis in the direction opposite to the direction toward said position and of sheet transport.

9. An apparatus according to claim 8, said friction member being a roller mounted rotatably on said lower end, said apparatus further comprising drive means including a drive element rotatable about said axis and a driven element on said roller for rotating said roller so that its periphery at said line of contact is moved in the direction opposite to the direction of sheet transport.

* * * * *